US006357233B1

(12) United States Patent
Marks

(10) Patent No.: US 6,357,233 B1
(45) Date of Patent: Mar. 19, 2002

(54) AIR SWITCH OPERATOR

(76) Inventor: Kipley Roydon Marks, 61 St. Heliers Bay Road, St. Heliers, Auckland (NZ)

( * ) Notice: Subject to any disclaimer, the term of this patent is extended or adjusted under 35 U.S.C. 154(b) by 0 days.

(21) Appl. No.: 09/552,552

(22) Filed: Apr. 19, 2000

(30) Foreign Application Priority Data

Apr. 20, 1999 (NZ) ..... 333891
May 12, 1999 (NZ) ..... 335764

(51) Int. Cl.[7] ..... F15B 7/10; F04B 7/00
(52) U.S. Cl. ..... 60/592; 417/466; 417/520
(58) Field of Search ..... 417/466, 509, 417/514, 520, 553; 60/592

(56) References Cited

U.S. PATENT DOCUMENTS 4,169,353 A * 10/1979 Fresard ..... 60/592
4,577,353 A 3/1986 Viegener
4,647,738 A 3/1987 Diamond
5,655,890 A * 8/1997 Liao ..... 417/234

FOREIGN PATENT DOCUMENTS

EP 0302158 A2 2/1989
EP 0 302 158 A2 2/1989
EP 0480221 A2 4/1992

* cited by examiner

*Primary Examiner*—Charles G. Freay
(74) *Attorney, Agent, or Firm*—Young & Thompson

(57) ABSTRACT

A pneumatic operator for an air switch is provided. The operator is used to deliver at pulse of relatively high pressure air to an air switch, such as an air switch which would be commonly used in a spa bath or spa pool installation to operate a pump. The operator has a cylindrical plunger within which is provided a stationary body and an O-ring on an outer surface of the stationary body provides a seal between the stationary body and the plunger. Depression of the plunger expels the air from the apparatus to operate an air switch. When the plunger is returning to its original position, the seal can move to allow air from the surrounding environment to enter the space between the plunger and the stationary body.

19 Claims, 1 Drawing Sheet

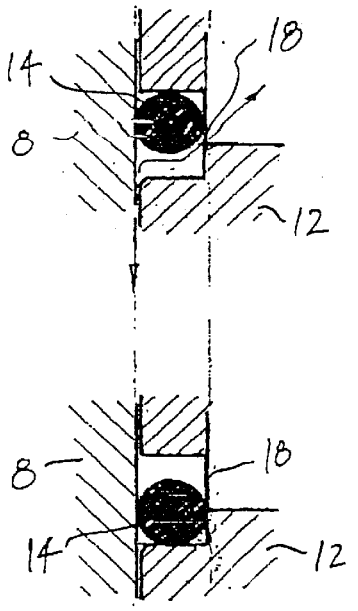
FIG 3
FIG 2
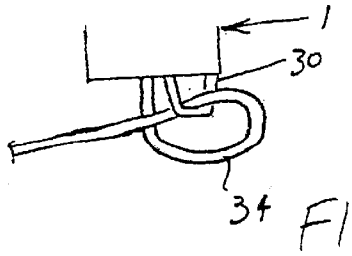
FIG 5
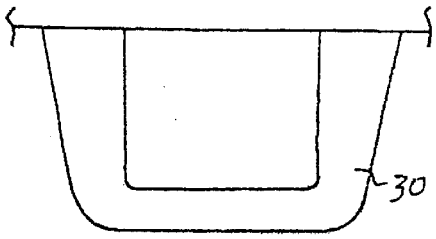
FIG 4
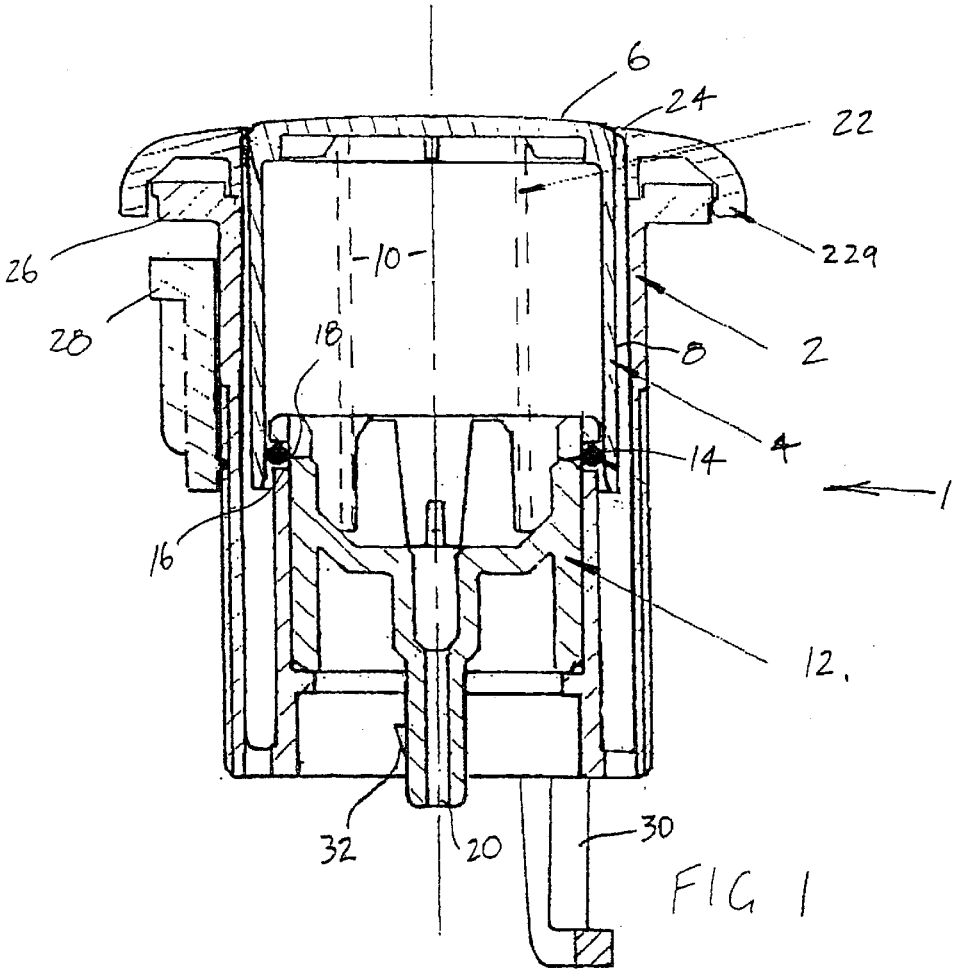
FIG 1

AIR SWITCH OPERATOR

BACKGROUND OF THE INVENTION

This invention relates to apparatus for operating pneumatic switches, commonly referred to as air switches.

"air switch" is the name generally used to refer to devices that are actuated by delivery of a pulse of relatively high pressure air. Air switch assemblies usually comprise an electric switch, usually a diaphragm type switch. In use, the pulse of high pressure air, when incident upon a diaphragm, causes movement of the diaphragm which in turn causes the engagement or disengagement of electrical contacts to open or close an electric circuit.

Air switches are commonly used in installations such as spa baths or spa pools to operate pumps. They may also be used in a variety of other applications, for example for the operation of waste disposers in or adjacent to household kitchen areas. The main reason for use of air switches is to provide electrical safety. The delivery of a pulse of air to a remote location where electric contacts are located, minimises the risk of inadvertent electrocution of a user.

Known air switch operators work on a bellows system. Therefore, they typically include a push button mounted in a housing, with the flexible bellows provided between the button and an end of the housing. An air inlet/outlet port is usually provided at the end of the housing. When a user presses on the push button, the bellows usually compress in a concertina-like fashion to expel air out of the inlet/outlet port under pressure. Some form of biasing means, for example a spring, is provided to return the button to the initial position once a user has removed a finger from the button. In this way, air is returned from the inlet/outlet port into the bellows. The primary disadvantage with the bellows system is that the bellows themselves need to be constructed from a flexible material which will inevitably wear as a result of flexing in use. For example, the material which is most commonly used is a rubber or plastics material and such materials ultimately fatigue and perish so that air escapes from the bellows.

It is an object of the present invention to provide a pneumatic switch operator which will at least go some way toward overcoming the foregoing disadvantages, or which will at least provide the public with a useful choice.

The invention consists of a pneumatic operator including a plunger having an end wall and one or more side walls defining a space therebetween and a button surface for application of a force by a user in use to displace the plunger, an inner body provided in use within the one or more side walls, sealing means provided between the side walls and the inner body, and an air inlet/outlet port provided in the inner body or the plunger, the arrangement and construction being to allow the plunger to move relative to the inner body whereby movement of the inner body into the plunger expels air from the space out of the inlet/outlet port.

To those skilled in the art to which the invention relates, many changes in construction and widely differing embodiments and applications of the invention will suggest themselves without departing from the scope of the invention as claimed herein. The disclosures and the descriptions herein are purely illustrative and are not intended to be in any sense limiting.

The invention consists in the foregoing and also envisages constructions of which the following gives examples only.

BRIEF DESCRIPTION OF THE DRAWINGS

One preferred form of the invention and modifications thereof will now be described with reference to the accompanying drawings in which:

FIG. 1 is a front elevation in cross-section of apparatus in accordance with the present invention, FIGS. 2 and 3 are enlarged front elevations in cross-section showing the sealing means of FIG. 3 when displaced in two different positions.

FIG. 4 is a further elevation of a part of the apparatus of FIG. 1 including a clearer view of an air supply line retention means in accordance with the present invention, and FIG. 5 is a diagrammatic sketch of a part of the apparatus of FIG. 1 including an air supply line.

DESCRIPTION OF THE PREFERRED EMBODIMENTS

Referring to FIG. 1, a pneumatic operator for switch apparatus commonly referred to as an air switch is shown generally referenced 1. The apparatus has a housing 2 within which a plunger 4 is provided. The plunger has an upper external surface 6 which provides a push button surface for a user to depress in use, using a finger for example. It will be seen by one skilled in the art that other embodiments of the invention may require the "button" to be pulled in use. The lunger also has one or more walls 8 enclosing a space 10 which as will be seen further below forms a working chamber for displacement of air when relative movement occurs between the plunger and an inner body 12. The walls 8 also enclose a part of the inner body 12 which may be provided separately from, or as a part of, the housing 2. Sealing means comprising an O-ring 14 are provided in a locating groove 16 of the inner body. As will be described in further detail below, the locating groove 15 allows for a predetermined displacement of the O-ring 14 in use, and a number of apertures 16 comprising venting means are provided in the locating groove 16. It will be seen, to one skilled in the art, that at least one edge of locating groove 16 could simply be formed by a circlip.

The inner body 12 has an inlet/outlet port 20 which in use is attached to an air line 34 (not shown in FIGS. 1–4) so that a pulse of relatively high pressure air may be delivered to a remotely located electrical diaphragm switch or the like. It will be seen to one skilled in the art that the inlet/outlet port 20 could alternatively be provided in the plunger. A biasing means comprising a spring, for example a coil spring 22 is provided in order to keep the plunger 4 in a position where it is disposed away from the inner body 12. The plunger 4 is prevented from escaping the body under the influence of the spring 22 by use of a collar 22*a* which makes a snap-fit connection, for example, with the body. As can be seen from FIG. 1, the edges 24 of the collar engage with the periphery of the button surface 6 to prevent the plunger from escaping from the body it will also be seen that the body includes a shoulder 26 which in use abuts a surface of a bench or a spa pool surround, for example. The housing can then be secured to the spa pool wall or bench surface by use of a threaded collar 28.

A part of a retention loop 30 is shown in FIG. 1. The loop is shown more clearly in direct front elevation in FIG. 4. The loop assists in retaining the air supply line in connection with the inlet/outlet port 20, as will be described further below with reference to FIG. 5. One or more projections or barbs 32 may also be provided on an external surface of the inlet/outlet port 20 to assist with retention of the air supply line.

In use, depression of the plunger by a user pressing button surface 6 moves the plunger 4 relative to the inner body 12 in a direction toward the inner body so that walls 8 of the plunger side relative to the sealing means comprising O-ring 14. This reduces the size of space 10 and forces some of the air out inlet/outlet port 20 to provide a pulse of relatively high pressure air to the air line to activate the electrical diaphragm switch.

Referring to FIG. 2, the action of O-ring 14 in the locating groove 16 can be seen in more detail. When the plunger is pressed downwardly by a user, the O-ring 14 slides downwardly within the groove 16 as a result of the friction between the O-ring and the wall 8 with which it is in sealing contact. As can be seen from FIG. 2, the position of the O-ring prevents any egress of air from space 10 while the plunger 4 is being depressed.

Once the plunger has reached the base of its movement, or once the electric switch has been activated and this has been noticed by a user, the user removes his or her finger from the push button, and the force exerted by spring 22 returns the plunger to the position shown in FIG. 1. As the plunger begins to return to the starting position, the walls 8 of the plunger move the O-ring upwardly a slight distance as shown in FIG. 3 until the O-ring is captured by an upper shoulder of the groove 16. As can be shown in FIG. 3, there is sufficient distance now in this position for air from the external environment to enter the space 10 through aperture 18. Therefore, air from the supply line is not required to enter inlet/outlet port 20 in order to supply space 10 with the air required to allow the plunger to return to the position as shown in FIG. 1.

Turning to FIG. 5, a possible configuration of the air supply line 34 being supported by the retention loop 30 is shown. The loop 30 is used to bear some or most of the force acting on the air supply line. Such force usually results from the weight of the supply line 34 itself but may also exist from the line being placed under tension during installation, or from interference with the line in use. Therefore, loop 30 assists in preventing the air supply line being inadvertently disconnected from the inlet/outlet port. It will be seen that the loop 30 could also be provided in the form of a projection such as a hook or support arm.

The operation of the apparatus described above provides considerable advantages. Firstly, the use of an O-ring as the sealing means overcomes the problem of fatigue suffered by air switches which rely on a bellows system. An O-ring will stand many switching operations without any measurable signs of fatigue or wear.

Another advantage results from the O-ring being located within the walls of the plunger in this orientation, it is almost impossible for dirt to build up between the walls of the plunger and the O-ring which could be a problem if the O-ring was located externally of the plunger in which case dirt from the external environment could mount around the O-ring and cause the button to "stick". In the present arrangement, any dirt which finds its way into the housing is likely to fall away by the influence of gravity without building up on the O-ring.

Allowing the sealing means to act as a valve so that air may return to the working chamber 10 also provides considerable advantages. A common problem with air switches in hot environments is that the air in the system expands with heat and in doing so can operate the air switch unintentionally. By having the air flow open in the rest position as with the present invention, the air can vent to atmosphere as it expands, so the air switch is not operated. Furthermore, in some cases with known air switches, when the plunger is pushed fully down, the high pressure created operates the electrical switch but is also sufficient to force air out of joints in the line. This does not hinder the operation of the electric switch, but does causes problems when the operator removes his or her finger from the plunger, in these instances, the spring can often not return the plunger to the rest position because of the vacuum created in the line. The vacuum prevents the plunger moving, so the plunger stays down which is irritating and may be dangerous if a user needs to activate the button again immediately to switch a pump off, for example. With the present invention, this problem is overcome as air is returned to the working chamber from the external environment directly past the sealing means rather than relying on air within the air line to feed the working chamber.

What I claimed is:

1. A pneumatic operator comprising:

a housing assembly;

a plunger retained within said housing assembly and moveable therewithin from a first position to a second position, said plunger having a surface for application of force by a user to displace said lunger between said first and second positions, walls of said plunger and said housing assembly together defining a space;

a seal between said plunger and said housing assembly;

an air inlet/outlet port in said housing assembly and communication with said space, wherein movement of said plunger from said first position to said second position expels air from said space through said inlet/outlet port; and a vent that opens to allow air to enter said space when said plunger is moved from said second position to said first position.

2. The pneumatic operator as claimed in claim 1, wherein said seal comprises an O-ring.

3. The pneumatic operator as claimed in claim 1, wherein said seal is on said housing assembly.

4. The pneumatic operator as claimed in claim 1, wherein said housing assembly includes a first shoulder against which said seal is retained.

5. The pneumatic operator as claimed in claim 4, wherein said housing assembly includes a second shoulder that is opposite said first shoulder and wherein said seal is retained between said first and second shoulders.

6. The pneumatic operator as claimed in claim 5, wherein said vent is adjacent to one of said first and second shoulders, wherein movement of said plunger from said first position to said second position displaces said seal toward one of said first and second shoulders to close said vent and movement of said plunger from said second position to said first position displaces said seal toward the other of said first and second shoulders to open said vent.

7. The pneumatic operator as claimed in claim 1, further comprising a supply line retainer to retain an air supply line adjacent to said air inlet/outlet port.

8. The pneumatic operator as claimed in claim 7, wherein said supply line retainer includes one of a supporting loop, arm, and projection on which said air supply line rests.

9. The pneumatic operator as claimed in claim 7, wherein said supply line retainer includes a barb on an external surface of said air inlet/outlet port.

10. A pneumatic operator comprising:

a housing assembly;

a plunger retained within said housing assembly and moveable therewithin from a first position to a second position, said plunger having a button surface for application of force by a user to displace said plunger between said first and second positions, walls of said plunger and said housing assembly together defining a space therebetween;

sealing means between said plunger and said housing assembly for sealing said space;

an air inlet/outlet port in the housing assembly; and venting means for venting said space, wherein movement of said plunger from said first position to said second position expels air from said space through said air inlet/outlet port; and wherein movement of said plunger from said second position to said first position opens said venting means to allow air to enter said space through said venting means.

11. The pneumatic operator as claimed in claim 10, wherein said sealing means comprises an O-ring.

12. The pneumatic operator as claimed in claim 10, wherein said sealing means is on said housing assembly.

13. The pneumatic operator as claimed in claim 10, wherein said housing assembly includes a first shoulder against which said sealing means is retained.

14. The pneumatic operator as claimed in claim 13, wherein said housing assembly includes a second shoulder opposite said first shoulder and said sealing means is retained between said first and second shoulder.

15. The pneumatic operator as claimed in claim 14, wherein said venting means comprises an aperture in said housing assembly adjacent to one of said first and second shoulders, whereby movement of said plunger from said first position to said second position displaces said sealing means toward one of said first and second shoulders to obstruct said aperture to prevent egress of air through said venting means and movement of said plunger from said second position to said first position displaces said sealing means toward the other of said first and second shoulders to allow ingress of air into said space through said aperture.

16. The pneumatic operator as claimed in claim 10, further comprising supply line retention means for assisting retention of an air supply line in connection with said air inlet/outlet port.

17. The pneumatic operator as claimed in claim 16, wherein said supply line retention means includes one of a supporting loop, arm and projection on which a pair of said air supply line rests.

18. The pneumatic operator as claimed in claim 16, wherein said supply line retention means includes a barb on an external surface of said air inlet/outlet port.

19. A pneumatic operator comprising:

a plunger having an end wall and one or more side walls defining a space therebetween and a button surface for application of a force by a user to displace said plunger;

an inner body provided within said one or more side walls;

a seal between said one or more side walls and said inner body;

an air inlet/outlet port in one of said inner body and said plunger, said plunger being movable relative to said inner body to expel air from said space out of said air inlet/outlet port; and a supply line retainer that is attached to said inner body and that retains an air supply line adjacent to said air inlet/outlet port, said supply line retainer including one of a supporting loop, arm and projection on which a part of said air supply line rests.

* * * * *

Disclaimer 6,357,233 — Kipley Roydon Marks, Auckland, (NZ). AIR SWITCH OPERATOR. Patent dated March 19, 2002. Disclaimer filed Sept. 17, 2002 by the Inventor, Kipley Roydon Marks.

Hereby enters this disclaimer to claims 7, 8, 9, 16, 17, 18 and 19 of said patent.

*(Official Gazette, May 13, 2003)*